US007487761B1

(12) United States Patent
Culbertson et al.

(10) Patent No.: US 7,487,761 B1
(45) Date of Patent: Feb. 10, 2009

(54) DETECTION OF FUEL SYSTEM PROBLEMS

(75) Inventors: Thomas Raymond Culbertson, Livonia, MI (US); Ross Dykstra Pursifull, Dearborn, MI (US); Dennis McDonald, New Boston, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 0 days.

(21) Appl. No.: 11/782,217

(22) Filed: Jul. 24, 2007

(51) Int. Cl.
*F02M 37/04* (2006.01)
*F02M 37/08* (2006.01)

(52) U.S. Cl. ..... 123/497; 123/198 D

(58) Field of Classification Search ..... 123/446, 123/198 D, 497, 480, 486, 357–359; 73/114.61, 73/114.38, 114.41, 114.42, 114.43, 114.01; 701/107, 102, 101; 323/351
See application file for complete search history.

(56) References Cited

U.S. PATENT DOCUMENTS 5,335,539 A 8/1994 Sweppy et al.
5,749,344 A * 5/1998 Yoshiume et al. ..... 123/399
6,032,639 A * 3/2000 Goto et al. ..... 123/295
6,925,990 B1 * 8/2005 Konopacki ..... 123/497
6,941,785 B2 9/2005 Haynes et al.
2005/0051139 A1 3/2005 Slater et al.
2007/0246020 A1 * 10/2007 Sawut et al. ..... 123/495
2007/0246021 A1 * 10/2007 Takayanagi et al. ..... 123/497

* cited by examiner

*Primary Examiner*—Mahmoud Gimie
(74) *Attorney, Agent, or Firm*—Brinks Hofer Gilson & Lione

(57) ABSTRACT

A method for detecting failures in a fuel system of a motor vehicle including monitoring a feed-forward table of a fuel pump controller that is electrically connected to a fuel pump of the fuel system. The fuel pump controller is electrically connected to a rail pressure sensor, which is coupled to the fuel injector rail. The actual fuel injector rail pressure measured by the rail pressure sensor is compared to a desired fuel injector rail pressure associated with the feed-forward table. The feed-forward table is adjusted if the actual fuel injector rail pressure is less than the desired fuel injector rail pressure. A fuel system error is signaled if an adjusted feed-forward table differs from an initial feed-forward table. A fuel system failure is signaled of the adjusted feed-forward table requires a saturation voltage of the controller.

20 Claims, 4 Drawing Sheets

DETECTION OF FUEL SYSTEM PROBLEMS

BACKGROUND OF THE INVENTION

1. Field of the Invention

The present invention generally relates to automotive fuel systems. More specifically, the invention relates to detecting a problem with a fuel injection system.

2. Description of Related Art

Existing fuel systems are not capable of detecting problems that may render the system unable to achieve a desired pressure in the fuel rail of an engine. The inability of the system to reach the desired fuel pressure may result in, for example, decreased engine performance, efficiency, and reliability. One cause of such a problem may be an obstructed fuel filter located between the fuel pump and the fuel rail. Another cause may be a weakening, or imminent failure, of the fuel pump. In both cases, the pressure in the fuel rail will be reduced, resulting in the above mentioned decreased engine characteristics.

SUMMARY OF THE INVENTION

In overcoming the enumerated drawbacks and other limitations of the related art, the present invention provides a method for detecting failures in an automotive fuel system. The fuel system includes a fuel pump providing fuel from a fuel tank to a fuel injector rail of an engine. A fuel pump controller is electrically connected to the fuel pump and a rail pressure sensor. The rail pressure sensor is attached to the fuel injector rail in fluid communication with fuel being provided from the fuel tank. The method includes monitoring an actual fuel pump parameter of the fuel pump and a fuel injector rail pressure; comparing the actual fuel pump parameter required to achieve a desired fuel injector rail pressure to an initial fuel pump parameter to achieve the desired fuel injector rail pressure; and signaling a fuel system problem if a difference between the actual fuel pump parameter and the initial fuel pump parameter exceeds a predetermined threshold.

In one embodiment, the predetermined threshold corresponds to a saturation value of the fuel pump controller. In this embodiment, the fuel system problem corresponds to a failure if the actual fuel pump parameter corresponds to the saturation value of the fuel pump controller.

In another embodiment, the difference includes the actual fuel pump parameter being higher than the initial fuel pump parameter. In this embodiment, the fuel system problem corresponds to an error if the actual fuel pump parameter is different from the initial fuel pump parameter but does not correspond to the saturation value of the fuel pump controller. In some instances, the signaling step difference includes the actual fuel pump parameter being about 15% to 30% higher than the initial fuel pump parameter.

In one example, the fuel system problem corresponds to an obstructed fuel filter disposed between the fuel pump and the fuel injector rail. In another example, the fuel system problem corresponds to a reduction in performance of the fuel pump.

In various embodiments, the actual fuel pump parameter and the desired fuel injector rail pressure correspond to steady state parameters and pressures. In addition, the fuel pump parameter and the rail pressure sensor are preferably monitored a high-flow conditions.

In still other embodiments, the actual fuel pump parameter corresponds to an actual voltage applied across the fuel pump and the initial fuel pump parameter corresponds to an initial voltage applied across the fuel pump.

Yet other embodiments include the actual fuel pump parameter corresponding to a feed-forward table of the fuel pump controller and the initial fuel pump parameter corresponding to an initial feed-forward table of the fuel pump controller. This embodiment may optionally include adjusting the feed-forward table if an actual voltage of the fuel pump for the desired fuel injector rail pressure is different from a feed-forward table voltage.

Further objects, features and advantages of this invention will become readily apparent to persons skilled in the art after a review of the following description, with reference to the drawings and claims that are appended to and form a part of this specification.

DETAILED DESCRIPTION

Figure 1:
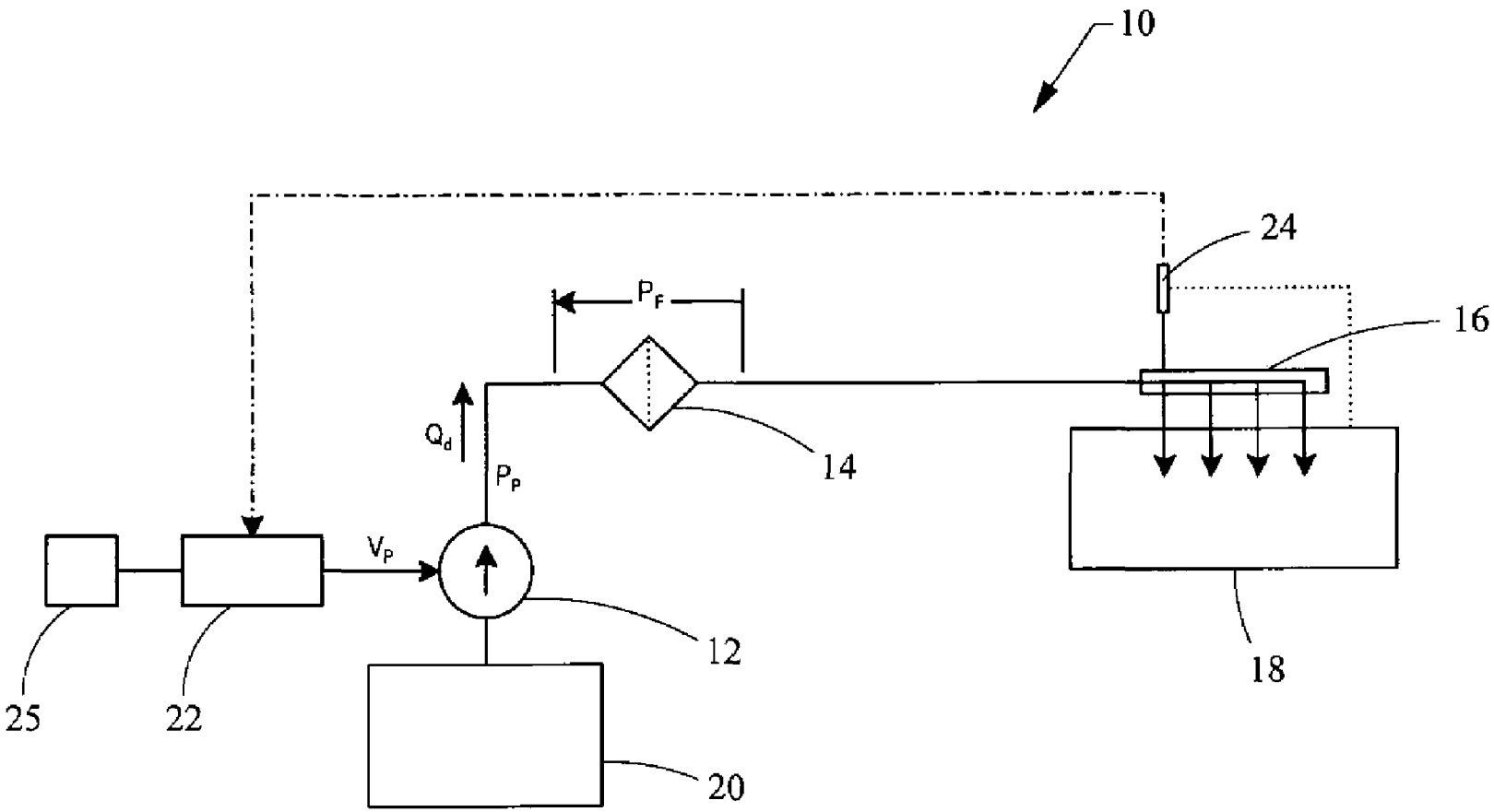
FIG. 1 is a schematic of a fuel system according to the present invention.

Referring now to FIG. 1, a fuel system according to the present invention for use in a motor vehicle is illustrated therein and designated at 10. As its primary components, the fuel system 10 includes a fuel pump 12, a fuel filter 14, a fuel injector rail 16, an air intake manifold 18, a fuel tank 20, a controller 22, a pressure sensor 24, and a signaling device 25. The fuel pump 12 provides fuel from the fuel tank 20 to the fuel injector rail 16 where injectors (not shown) provide the fuel to the air intake manifold 18. This creates a fuel-air mixture that is burned in combustion chambers of the engine (not shown) to which the air intake manifold 18 is attached.

The controller 22 is electrically connected to the fuel pump 12 and is configured to monitor and regulate various fuel pump parameters. One example of such a fuel pump parameter includes, but is not limited to, a voltage applied to the pump 12. As discussed in more detail below, the fuel pump parameter may also include an optional feed-forward table stored in the controller 22. The feed-forward table is used by the controller 22 to determine the voltage applied to the pump 12. The voltage is applied to the pump 12 to achieve a desired pressure in the fuel injector rail 16. The pressure sensor 24, also coupled to the controller 22, is in fluid communication with the fuel being provided to the fuel injector rail 16 and measures the fuel pressure. The controller 22 provides an initial voltage to the pump 12 to achieve the desired pressure. But if, for example, the fuel filer 14 becomes obstructed or the fuel pump 12 weakens, the controller will adapt and provide additional voltage (i.e. actual voltage) to the pump 12 to ensure that the desired pressure is maintained.

The controller 22 also compares the actual voltage being provided to the pump 12 to the initial pump voltage. If the actual pump voltage exceeds the initial pump voltage by a predetermined threshold, the controller is configured to signal an operator of the motor vehicle that there is a problem with the fuel system 10. This is accomplished by coupling the controller 22 to the signaling device 25. The signaling device 25 is any device capable of providing, for example, audible, visual or haptic feedback to the operator. The predetermined threshold may be any of a variety of voltages above the initial value, in which case the controller 22 may signal an error with the fuel system. In other instances, if the controller 22 reaches the maximum voltage that it can provide to the pump 12, otherwise known as the saturation value, then the controller 22 may signal a fuel system failure. Once the saturation value has been reached, the controller 22 cannot supply any additional voltage to the pump 12, which means no additional pressure may be supplied to the fuel rail 16 so as to maintain the required steady state pressure for a given performance level of the engine. Consequently, once at the saturation value, any further reduction in performance due to the obstructed filter 14 or weakened pump 12 will adversely affect engine performance.

It is important to note that the voltage and pressures are considered at steady state, rather than at transient, operating conditions and preferably at high-flow conditions. One non-limiting example of a steady state operating condition is when the vehicle is being driven at about 70-MPH, with the engine speed being at about 2,000-RPM for about 5-minutes. This may also correspond to a relatively high-flow condition of the pump 12. A non-limiting example of a low-flow condition of the pump 12 would occur when the vehicle is idling. During idle, a minimum amount of fuel, voltage and pressure are being provided by the fuel system, thereby making problems less apparent. However, it should understood that the present invention may apply equally to high and low flow conditions depending on the needs of a particular application.

Figure 2:
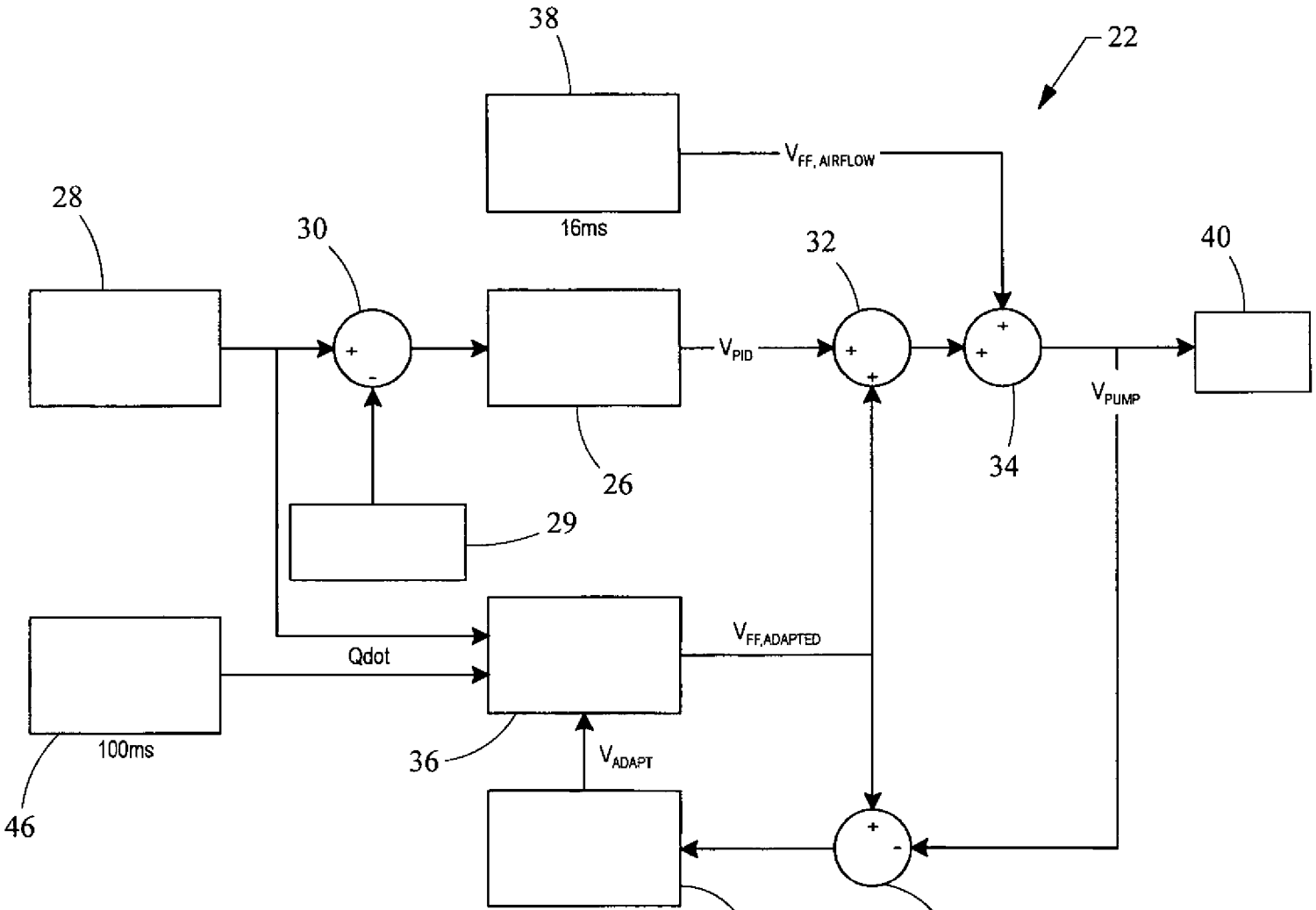
FIG. 2 is a schematic of a control system for the fuel system.

Turning now to the schematic of FIG. 2, one non-limiting example of the controller 22 is shown. This example includes a proportional-integral-derivative (PID) controller 26. The PID controller 26 takes as its input a pressure differential calculated by a subtractor 30. The calculated pressure differential is the difference between a desired rail pressure 28 minus an actual rail pressure 29. The desired rail pressure 28 may, for example, be based upon various fuel injector characteristics and fuel rail temperature. Using this pressure difference, the PID controller 26 calculates a PID pump voltage. The PID voltage is modified by a summer 32 where a feed-forward term provided from a feed-forward table 36 is added to the PID voltage. This voltage is optionally modified by another summer 34 where an airflow modification term 38 is added to determine the final pump voltage 40 applied to the fuel pump.

Figure 3:
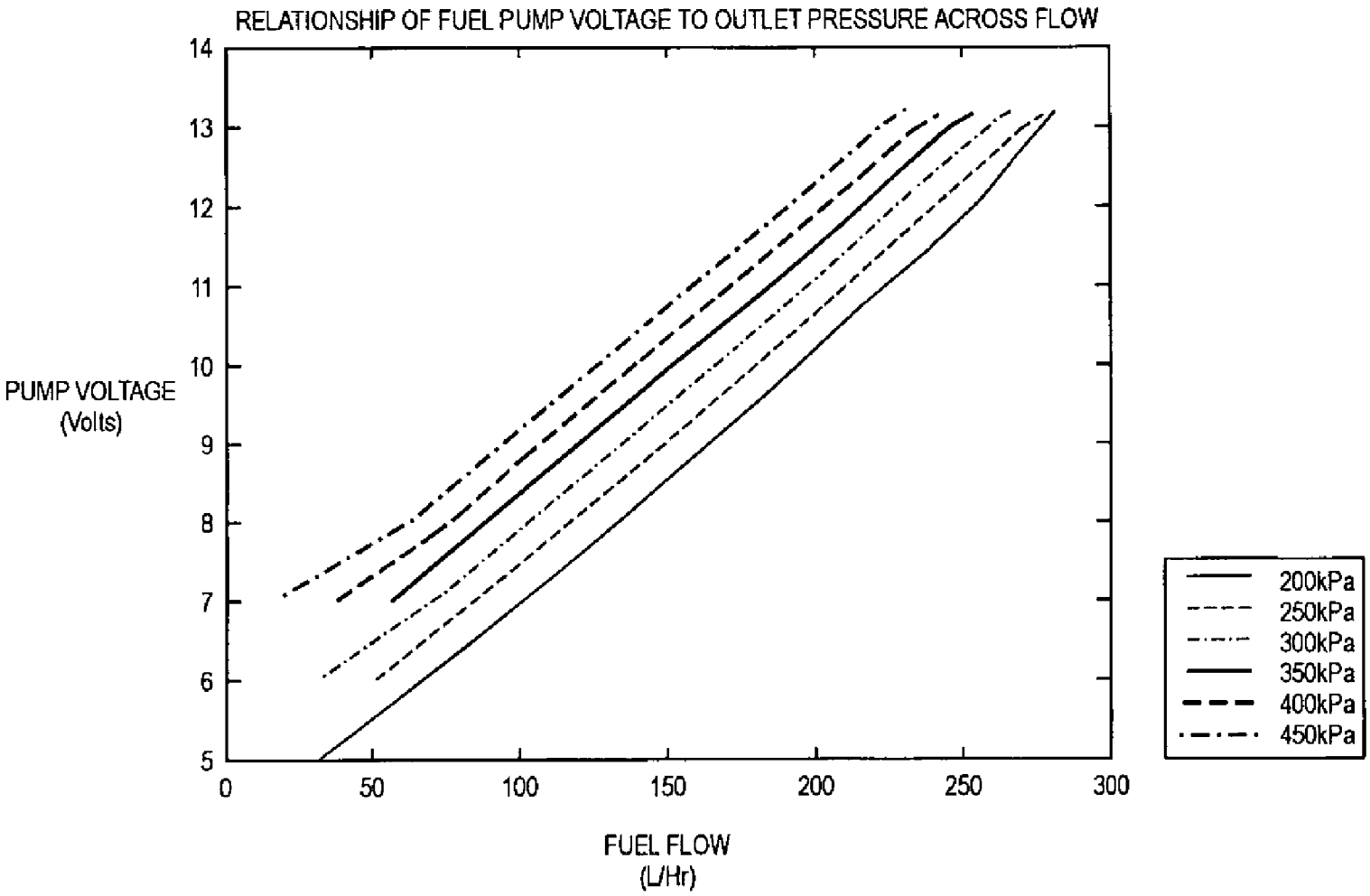
FIG. 3 is a chart showing one example of a feed-forward table.

The controller 22 may optionally be configured to adapt the feed-forward table 36 to match the actual operating conditions. The feed-forward table 36 uses as its input the desired rail pressure 28 and a fuel flow estimate 46 and compares it to a calculated or empirically derived feed-forward table or chart relating fuel flow to pump voltage and rail pressure. One example of such a chart is shown in FIG. 3. As shown, FIG. 3 provides the voltage required to achieve a desired fuel flow, in lbs/hour, for a variety of pressures. For instance, this chart shows that about 7 volts applied to the fuel pump will achieve about 100 lb/hr of fuel flow at about 200 kPa of pressure.

Figure 4:
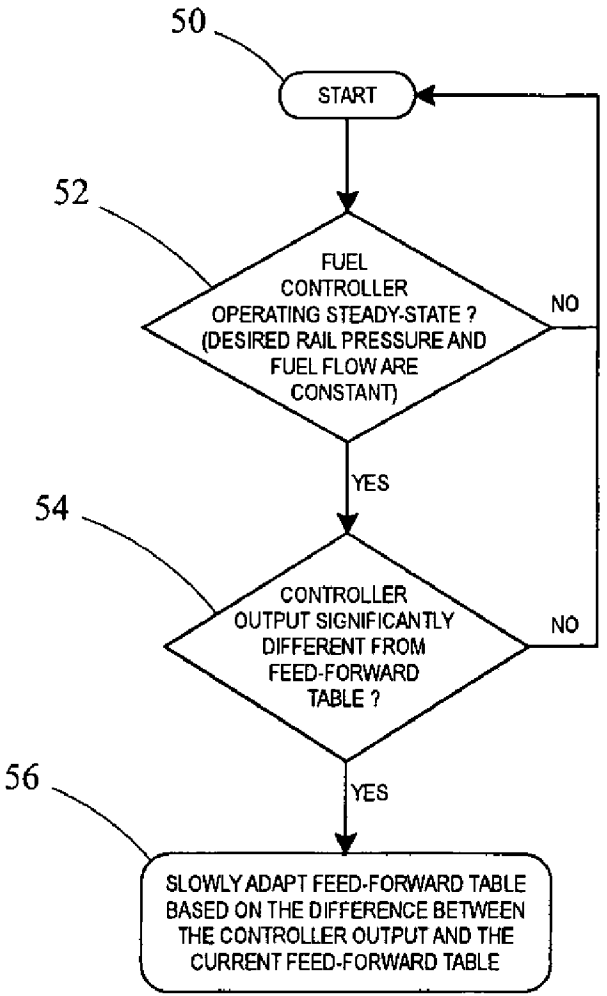
FIGS. 4-6 are a series of flow charts illustrating a method of detecting a problem with the fuel system.

A feed-forward difference is calculated for box 44 by a subtractor 42, where the final pump voltage is subtracted from the feed-forward term 36 provided to the summer 32. The feed-forward difference is provided at box 44 as an adapted input voltage to box 36 which adapts the feed-forward table to match the current conditions. Subsequently, an adapted feed-forward voltage is provided back to the summer 32 and subtractor 42. This process is summarized in the flow chart of FIG. 4.

The process starts at box 50 and proceeds on to box 52 where the controller 22 determines whether it is operating at a steady-state condition. If it is not, the process proceeds back to start at box 50. If yes, the process moves on to box 54 where the controller determines if the pump output voltage differs significantly from that called for in the feed-forward table. If they do not significantly differ, the process proceeds back to start. If they do differ significantly, the process moves to box 56 where the feed-forward table is slowly adapted based on the above difference.

Figure 5:
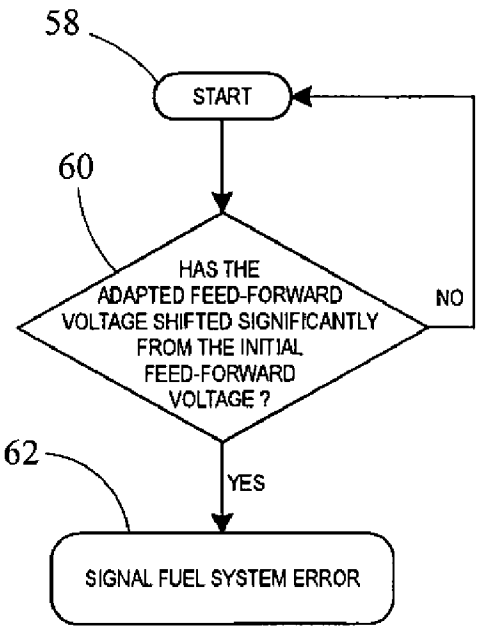
Figure 6:
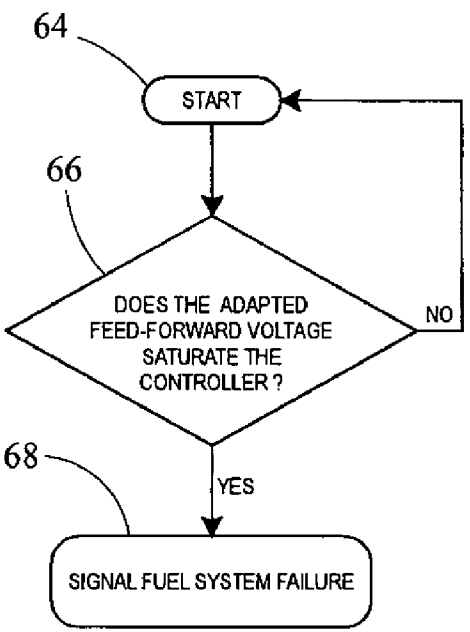

The initial feed-forward table is based on the starting conditions of the fuel system as manufactured and is stored in the controller 22. A fuel system problem may be signaled by the controller 22 if the adjusted feed-forward table of box 36 has shifted significantly, by a predetermined threshold, from the initial feed-forward table. In one instance, illustrated in FIG. 5, the fuel system problem may be classified as an error, if the voltage required by the adjusted feed-forward value exceeds the voltage required by the initial feed-forward value, while at the same time being less than the saturation value of the controller 22. This is determined in box 58. If it does, a fuel system error is signaled n box 60. If not, the method loops back to start at box 62. The amount that the adjusted feed-forward table will need to exceed the initial feed-forward table in order to signal an error will vary depending on the needs of a particular application but, for example, may be in the range of about 15%-30%. In another instance, as illustrated in FIG. 6, the fuel system problem may be classified as a fuel system failure. This occurs if the voltage required by the adjusted feed-forward table corresponds to the saturation value of the controller 22. This is determined in box 66. If it does, a fuel system failure is signaled in box 68. If not, the method loops back to start at box 64.

As a person skilled in the art will readily appreciate, the above description is meant as an illustration of implementation of the principles this invention. This description is not intended to limit the scope or application of this invention in that the invention is susceptible to modification, variation and change, without departing from spirit of this invention, as defined in the following claims.

We claim:

1. A method for detecting failures in a fuel system for a motor vehicle, the fuel system includes a fuel pump providing fuel from a fuel tank to a fuel injector rail of an engine, a fuel pump controller is electrically connected to the fuel pump and a rail pressure sensor, the rail pressure sensor is attached to the fuel injector rail in fluid communication with fuel being provided from the fuel tank, the method comprises:

monitoring an actual fuel pump parameter of the fuel pump and a fuel injector rail pressure;

comparing the actual fuel pump parameter required to achieve a desired fuel injector rail pressure to an initial fuel pump parameter to achieve the desired fuel injector rail pressure; and signaling a fuel system problem if a difference between the actual fuel pump parameter and the initial fuel pump parameter exceeds a predetermined threshold.

2. The method of claim 1 wherein the signaling step predetermined threshold corresponds to a saturation value of the fuel pump controller.

3. The method of claim 2 wherein the signaling step fuel system problem corresponds to a failure if the actual fuel pump parameter corresponds to the saturation value of the fuel pump controller.

4. The method of claim 1 wherein the signaling step difference includes the actual fuel pump parameter being higher than the initial fuel pump parameter.

5. The method of claim 1 wherein the signaling step fuel system problem corresponds to an error if the actual fuel pump parameter is different from the initial fuel pump parameter but does not correspond to a saturation value of the fuel pump controller.

6. The method of claim 5 wherein the signaling step difference includes the actual fuel pump parameter being about 15% to 30% higher than the initial fuel pump parameter.

7. The method of claim 1 wherein the signaling step fuel system problem corresponds to an obstructed fuel filter disposed between the fuel pump and the fuel injector rail.

8. The method of claim 1 wherein the signaling step fuel system problem corresponds to a reduction in performance of the fuel pump.

9. The method of claim 1 wherein the comparing step desired fuel injector rail pressure corresponds to a steady state pressure.

10. The method of claim 1 wherein the monitoring step actual fuel pump parameter corresponds to a steady state parameter.

11. The method of claim 1 further comprising monitoring the actual fuel pump parameter and the rail pressure sensor at a high-flow condition.

12. The method of claim 1 wherein the monitoring step actual fuel pump parameter corresponds to an actual voltage applied across the fuel pump.

13. The method of claim 10 wherein the comparing step initial fuel pump parameter corresponds to an initial voltage applied across the fuel pump.

14. The method of claim 1 wherein the monitoring step actual fuel pump parameter corresponds to a feed-forward table of the fuel pump controller.

15. The method of claim 14 wherein the comparing step initial fuel pump parameter corresponds to an initial feed-forward table of the fuel pump controller.

16. The method of claim 14 further comprising adjusting the feed-forward table if an actual voltage of the fuel pump for the desired fuel injector rail pressure is different from a feed-forward table voltage.

17. A device for detecting failures in a fuel system of a motor vehicle, the fuel system includes a fuel pump providing fuel from a fuel tank to a fuel injector rail of an engine, a rail pressure sensor is attached to the fuel injector rail in fluid communication with the fuel being provided from the fuel tank, the device comprises:

a fuel pump controller being electrically connected to the fuel pump and the rail pressure sensor, the fuel pump controller being configured to monitor an actual fuel pump parameter of the fuel pump and an actual fuel injector rail pressure measured by the rail pressure sensor and to compare the actual fuel pump parameter required to achieve a desired fuel injector rail pressure to an initial fuel pump parameter and to signal a fuel system problem if a difference between the actual fuel pump parameter and the initial fuel pump parameter exceeds a predetermined threshold.

18. The device of claim 17 wherein the actual fuel pump parameter and the initial fuel pump parameter respectively correspond to an actual fuel pump voltage and an initial fuel pump voltage.

19. The device of claim 17 wherein the actual fuel pump parameter and the initial fuel pump parameter respectively correspond to a feed-forward table of the controller and an initial feed-forward table of the controller.

20. The device of claim 19 further comprising the fuel pump controller being configured to adjust the feed-forward table if an actual voltage of the fuel pump for the desired fuel injector rail pressure is different from a feed-forward table voltage.

* * * * *